United States Patent [19]

Smeed

[11] Patent Number: 4,872,273

[45] Date of Patent: Oct. 10, 1989

[54] SPIKE SHOE SLIP

[76] Inventor: Clifford G. Smeed, 3625 Keating, 190 1, San Diego, Calif. 92110

[21] Appl. No.: 226,142

[22] Filed: Jul. 29, 1988

Related U.S. Application Data

[63] Continuation-in-part of Ser. No. 132,335, Dec. 14, 1987, abandoned.

[51] Int. Cl.[4] ..... A43B 5/00; A43B 3/10; A43C 13/12

[52] U.S. Cl. ..... 36/135; 36/7.3; 36/7.5

[58] Field of Search ..... 36/7.1 R, 7.1 A, 7.3, 36/7.5, 7.6, 127, 134, 135

[56] References Cited

U.S. PATENT DOCUMENTS

| | | | |
|---|---|---|---|
| 810,753 | 1/1906 | Hatfield | 36/135 X |
| 2,032,052 | 2/1936 | Friedenberg | 36/135 |
| 2,958,963 | 11/1960 | Lougheed | 36/127 |
| 3,020,654 | 2/1962 | McCann | 36/7.5 |
| 3,313,047 | 4/1967 | Svien | 36/7.3 |
| 3,566,488 | 3/1971 | Pilarski | 36/7.5 |
| 3,609,888 | 10/1971 | Rickman | 36/7.5 |
| 3,812,603 | 5/1974 | Goodman | 36/135 |
| 3,858,336 | 1/1975 | Brown | 36/135 AN |
| 3,883,963 | 5/1975 | Barbito Sr. | 36/135 |
| 4,258,483 | 3/1981 | Hogue | 36/135 |
| 4,693,019 | 9/1987 | Kim | 36/7.1 R |

FOREIGN PATENT DOCUMENTS

| | | | |
|---|---|---|---|
| 3044032 | 6/1982 | Fed. Rep. of Germany | 36/135 |

*Primary Examiner*—James Kee Chi

*Attorney, Agent, or Firm*—Charmasson & Holz

[57] ABSTRACT

A segmented slip designed to be placed over the bottom of the spiked shoe and support the wearer so that the spikes do not contract the ground. The slip has two generally rigid segments, one at the heel and another at the sole connected by a stretch mid-segment. The rigid segments are cross braced construction, allowing spikes between braces and maximum lateral and vertical support, covered by a slip membrane. Different sizes and spike patterns at the heel and sole are accommodated by the stretchable midsection. The slip is attached to the toe and heel of the shoe by flexible caps. The slip is thick enough to allow support under load without allowing spikes/protrusions to penetrate membrane. The slip is made form elastomeric material for comfort and flexibility to adapt to various sizes. The caps also allow easy removablilty.

11 Claims, 1 Drawing Sheet

SPIKE SHOE SLIP

PRIOR APPLICATION

This is a continuation-in-part of patent application Ser. No. 07/132,335, filed Dec. 14, 1987, which is now abandoned.

FIELD OF THE INVENTION

This invention relates to a shoe accessory, more specifically to spiked sports shoe slipovers.

BACKGROUND OF THE INVENTION

Many sports enthusiasts wear spiked or cleated shoes. The spikes give added resistance to slipping or sliding on soil, grass or other surfaces. The spikes thus improve performance and reduce the risk of injury. This type of shoe can be used in running, golf, football, baseball, soccer or other outdoor sports.

However, the sports enthusiast may need to periodically walk/run over a paved area or enter a building. Spiked shoe removal may not be practical. Carrying conventional shoe replacements may not be an option during play and walking barefoot may not be acceptable. Change of shoes, even if practical, consumes time. If shoes are soiled, enthusiasts may also be required to wash his or her hands, further consuming time. In addition to the comfort and convenience of the sports enthusiast, walking on spikes may damage the spikes, shoes, carpets, etc.

One approach to overcoming this problem has been removable cleats or spikes. Cleats or spikes are attached to a conventional or specially adapted shoe using straps or other means. This allows the sports enthusiast to easily remove spikes or cleats prior to walking on indoor or prepared surfaces. However, this approach requires wearing conventional shoes during game or compromises in sports shoe design to allow removable feature. These compromise shoes can not be as light or supporting a the sports shoes they replace because of the addition of removable attachment devices. Inadvertent loss of cleats or spikes could also be unsafe.

The closest prior art to the invention that is known to the applicant are overshoes, outer soles or cleat guard protective devices as shown in U. S. Pat. Nos.: 3,858,336; 2,958,963; and 3,566,488. Other types of overshoe protection devices are shown in U. S. Pat. Nos.: 4,693,019; 4,258,483; 3,812,603; 3,020,654; and 2,032,052, as well as German Pat. No. 3044-032. These prior art overshoe protective devices provide a raised platform attached to the sole and heel portions of the sports shoe and has a cavity or cavities for the spikes or cleats of the sports shoe to protrude into. Platform is generally made from plastic, rubber or other elastic material sometimes with hard inserts (see U. S. Pat. Nos.: 3,858,336; 2,958,963; 3,566,488; 3,020,654; and 4,693,019) but also may be made from generally rigid materials (see German Pat. No.: 3,044,032 and U. S. Pat. No. 4,258,483) or either/combination of materials (see U. S. Pat. No.: 2,032,052; and 3,812,603).

These prior art overshoe protective devices have serious limitations. Major limitations can be classified into two categories. The first limitation category is related to the need to balance the rigid vertical support objective (to maintain the spikes off the ground and react against normal shoe forces) with the flexibility objective (to bend with the shoe and adapt to different shoe types and sizes). The need for rigid vertical support results in increased height. This increased height may be compounded by any flexibility of the material which can cause compression under maximum load, but will further increase height under less than maximum vertical load. This added height can also create balance problems for the user.

The second major limitation category is related to the need to balance lateral support objectives (to provide a rigid platform to resist side loads) with the need for adaptability (interchangeability of slipover with many sport shoes). Some prior art designs provide large cavities for the spikes to protrude into, allowing many different spike patterns and shoe sizes to be accommodated. However, these largo cavities limit the amount of structure that can transfer lateral forces. Other designs provide flexible structures to adapt to the spike patterns, but the flexible material is not able to provide the same degree of lateral support without deformation. This lateral support problem is compounded by the increased height required to provide for lateral support. Significant lateral deformation over the increased height may be difficult to avoid while maintaining the ability to adapt to different shoe patterns and sizes.

What is needed is an overshoe protective device that provides firm lateral and vertical support to prevent damage to the spikes, shoe and user, while maintaining the ability to adapt to the variety of shoe sizes and spike patterns in current use

SUMMARY OF THE INVENTION

The principal and secondary objects of this invention are:

to cover spikes or other projections of sports shoes and allow walking on indoor or prepared surfaces without damage;

to allow removability and portability of slipover;

to provide comfort during covered spike walking; and to provide maximum flexibility and adaptability of slipover to fit many sizes of shoes.

These and other objects are achieved by providing a segmented slip designed to be placed over the bottom of the spiked shoe and support the wearer. The slip has two generally rigid segments, one at the heel and another at the sole connected by a stretched mid-segment. The rigid segments are cross constructed using braces, allowing spikes to protrude between braces while providing rigid lateral and vertical support, and covered by a membrane. Different sizes and spike patterns at the heel and sole are accommodated by the stretchable midsection. The slip is attached to the toe and heel of the shoe by flexible caps. The slip is thick enough to allow support under load without allowing spikes/protrusions to penetrate membrane. The slip is made from semi-rigid elastomeric material for comfort and flexibility. The caps also alloW easy removability.

PREFERRED EMBODIMENT OF THE INVENTION

Figure 1:
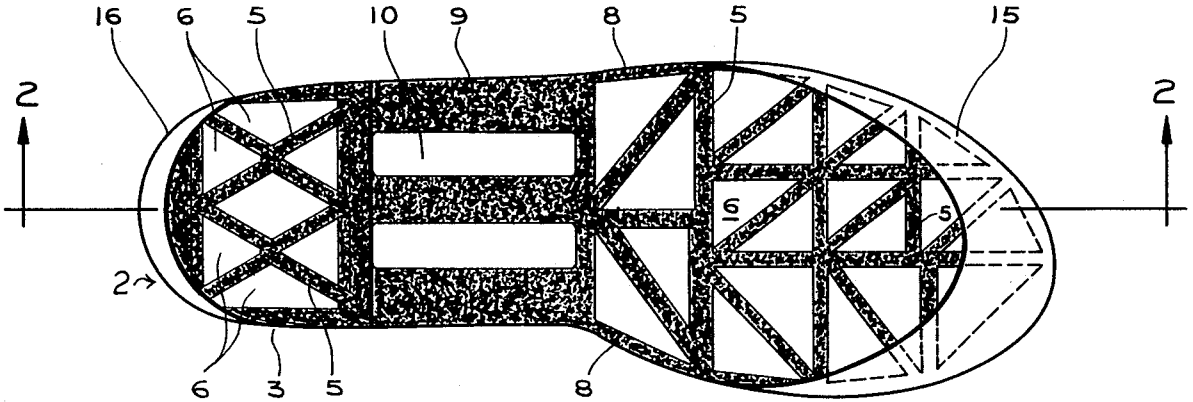
FIG. 1 is a top view of a slip.

FIG. 1 shows a top view of slipover or slip 2. The heel segment 3 is generally shaped to match a heel of a sports shoe, but does not need to exactly match. The segment structure visible in this top view comprises a generally rigid outer heel shaped ring 4, laterally supported by braces 5 arranged in a geometric pattern. BetWeen the braces 5 are cavities 6 which can accept spikes from a sports shoe. The pattern shown is a cross braced structure which provides maximum stability for a given amount of structural material. The brace pattern may also be selected so that at least one of the braces 5 or the wall of the ring 4 be adjacent to at least one of the spikes for further lateral stability and support.

The sole segment 7 construction is similar to the heel segment 3. A sole shaped ring 8 surrounds a plurality of braces 5. In the preferred embodiment, fore and aft (heel to toe direction) braces are included in the sole segment to accommodate the added lateral starting/-stopping loads expected at the sole location. The bracing pattern provides cavities 6 where the spikes of a sports shoe can be protected. The pattern of braces 5 can be selected to adapt to a variety of spike configurations and sizes. Pattern can also allow at least one spike to be adjacent to a brace producing added lateral support. The pattern of triangular bracing shown provides fore and aft as well as side lateral support.

The midsection membrane or middle segment 9 is a thin stretchable flexible member that interconnects the heel and sole segments. In the preferred embodiment, slots 10 are provided to increase flexibility and allow primarily tensile stress to be transmitted between the heel and sole. Compressive forces would be accommodated by a reduction in tensile forces in membrane 9 so that buckling would be avoided. In the preferred embodiment, the thickness of membrane 9 (see FIG. 2) allows the slip to be folded when stored or not in use on a shoe.

Figure 2:
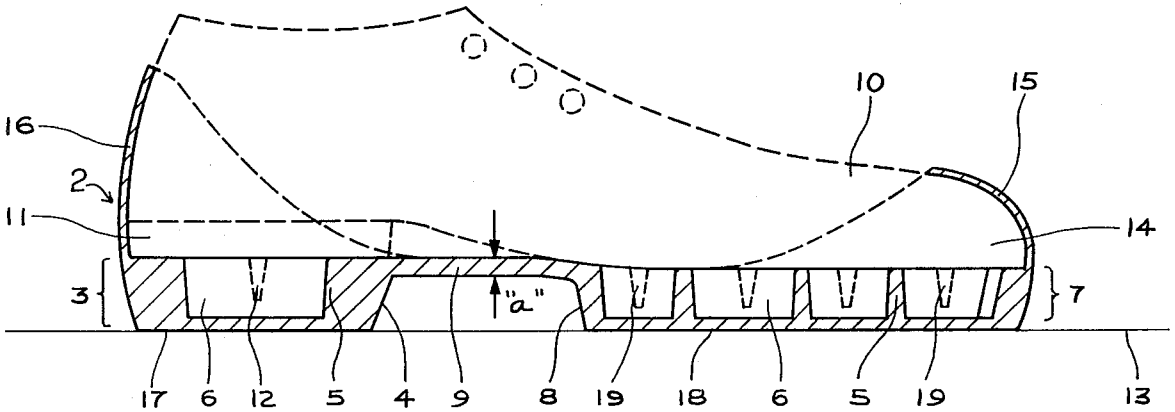
FIG. 2 is a cross sectional view of a slip.

FIG. 2 is a cross sectional view of the slip 2 in place over a spiked sports shoe 10 (shown dotted for clarity). The heel 11 of the spiked sports shoe 10 includes heel spikes 12. The spikes 12 are placed into cavities 6 between braces 5. The depth of the cavities 6 is just sufficient to keep the spikes from piercing the slip sole and contacting with the ground 13. In the preferred embodiment shown, the cavities 6 are 7.5 mm deep to match the 7.5 mm length of the spikes 12.

The flexible toe extension oz toe cap 15 grips the toe portion of the sports shoe opposite to the heel cap 16, pulling apart (putting tensile forces in) the midsection 9. The thickness "a" of midsection 9 in the preferred embodiment is 0.75 mm allowing stretchability to adapt to various sizes and configurations of spiked sports shoes. In the preferred embodiment, the heel bottom 17 and sole bottom 18 under the heel and sole segments are semirigid, similar to the thickness and construction of a shoe sole or heel. This semi-rigid heel bottom and sole bottom also allow for some limited bending, wear and provide added strength. Toe cap 15 and heel cap 16 are shaped and dimensioned to snugly stretch the membrane 9 between the bottom of heel 11 and sole 14. In the preferred embodiment, the segments 3, 7, and caps 15, 16 are all molded from a semi-rigid material to form a single snug fitting slip. The semi-rigid material, such as plastic or polymeric elastic material, is stretchable and flexible in thin cross sections, but generally rigid in thick cross sections.

The sole seqment 7 also allows the sole spikes 19 to protrude into the cavities 6 formed between the braces 5. Sole segment bottom 18 covers provides traction and prevents contamination from entering the cavities 6.

Other embodiments of the inventions are also possible. The slip 2 as shown may be stretched over a flat bottom spiked sports shoe as well as the arched shoe shown. The toe cap and heel cap are not required to be as high or cover portions of the top portions of the toe as shoWn, as long as the tensile stretch forces at the sides of the shoe are sufficient to retain the slip on the sports shoe. The segments, membranes and caps may be made from different materials, where segments are made from rigid materials and the membranes elastic materials. The heel bottom membrane may be replaced or augmented by a heel segment top membrane having a pattern of cavities matching the cavities 6 created by the spaces between the braces 5.

The combination of longitudinal, transversal and diagonal support formed by the bracing pattern 5, although necessary in order to provide good support and stability in all directions, can take a variety of configurations.

The midsection membrane 9 does not have to lie in a plane which includes the bottoms of the heel 11 and sole 14 as shown, but may present a continuous surface at the plane which includes the heel segment bottom 17 and sole segment bottom 18. The midsection membrane 9 may also lie in other planes between these two options. Other methods of attaching the slip are also possible, such as clips, bands, hooks, etc. Braces do not have to extend the full depth or thickness of the spikes, if sufficient vertical support is provided by the heel- and sole-shaped rings. Thickness of the segments may also be varied to allow the spikes to be separated from, or partially supported by, the heel and sole membranes.

While the preferred embodiment of the invention has been described and modifications thereto have ben suggested, other applications and modifications could be made without departing from the spirit of the invention and the scope of the appended claims.

What is claimed is:

1. A slip, for use with a sports enthusiast shoe having a heel, sole, and toe portions, and having anti-skid protrusions on a bottom surface of said shoe's sole and heel portions, said slip comprising:

a semi-rigid sole membrane capable of being placed proximate to said sole and generally covering a portion of said bottom surface of said sole;

first means for removably attaching said sole membrane to said shoe;

a stretchable midsection membrane attached to said sole membrane distal from said first means for attaching;

a semi-rigid heel membrane attached to said midsection distal from said sole membrane, said heel membrane capable of being placed proximate to said heel generally covering a portion of said heel bottom;

second means for removably attaching said heel membrane to said shoe;

a generally rigid heel segment attached to said heel membrane, said heel segment having a plurality of rigid brace within a heel-shaped ring, said braces and heel-shaped ring dimensioned and shaped to allow said spikes to protrude into cavities bounded by said braces and heel membrane;

a generally rigid sole segment attached to said sole membrane, said sole segment having a plurality of rigid braces within a sole-shaped ring, said braces and sole-shaped ring dimensioned and shaped to allow said spikes to protrude into cavities bounded by said braces and sole membrane; and said braces forming a combination of longitudinal, transversal and diagonal septi delineating said cavities.

2. The slip as claimed in claim 1, wherein said slip is entirely composed of a polymeric elastic material.

3. The slip as claimed in claim 2, wherein said first and second means for attaching comprises:

a flexible toe cap extending from said sole membrane distal from said midsection membrane; and a flexible heel cap extending from said heel membrane distal from said midsection membrane.

4. The slip as claimed in claim 3, wherein the thickness of the midsection membrane is approximately 0.75 mm.

5. The slip as claimed in claim 4, wherein said braces are shaped and dimensioned to provide said cavities 7.5 millimeter deep.

6. The slip as claimed in claim 5, wherein said anti-skid protrusions are 7.5 millimeter deep.

7. The slip as claimed in claim 6, wherein said slip is formed in a single piece construction resilient enough to adapt to a plurality of said shoe sizes.

8. The slip as claimed in claim 7, wherein said midsection membrane maY be folded upon itself to allow said heel segment to be in contact with said sole segment when said slip is not attached to said shoe.

9. The slip as claimed in claim 8, wherein at least one of said braces are shaped and dimensioned to be adjacent to at least one of said spikes.

10. The slip as claimed in claim 9, wherein said braces form a cross brace pattern within said heel shaped ring.

11. The slip as claimed in claim 10, wherein said braces form a triangular pattern within said sole shaped ring.

* * * * *